US007444724B1

(12) United States Patent
Perler

(10) Patent No.: US 7,444,724 B1
(45) Date of Patent: Nov. 4, 2008

(54) LACE SECURING APPARATUS

(76) Inventor: Janelle Perler, 9400 SW. 49th Pl., Cooper City, FL (US) 33328

( * ) Notice: Subject to any disclaimer, the term of this patent is extended or adjusted under 35 U.S.C. 154(b) by 97 days.

(21) Appl. No.: 11/411,080

(22) Filed: Apr. 24, 2006

Related U.S. Application Data

(63) Continuation-in-part of application No. 11/333,154, filed on Jan. 17, 2006, now Pat. No. 7,404,242.

(51) Int. Cl.
*A43C 7/04* (2006.01)
*A43C 7/02* (2006.01)
*A43C 7/00* (2006.01)

(52) U.S. Cl. ..... 24/712.3; 36/136; 36/50.1

(58) Field of Classification Search ..... 24/712.2, 24/712.3, 712.1; 63/19, 18, 23, 22, 21, 20; 36/139, 136, 1.5, 50.1
See application file for complete search history.

(56) References Cited

U.S. PATENT DOCUMENTS 4,507,882 A * 4/1985 Harrell ..... 36/136
4,536,975 A * 8/1985 Harrell ..... 36/136
4,553,293 A * 11/1985 Blum ..... 24/712.2
5,311,679 A * 5/1994 Birch, Sr. ..... 36/136
5,566,477 A * 10/1996 Mathis et al. ..... 36/100
5,775,011 A * 7/1998 Reitano, Jr. ..... 36/136
6,601,323 B2 * 8/2003 Tsujino et al. ..... 36/136

* cited by examiner

*Primary Examiner*—Robert J Sandy
(74) *Attorney, Agent, or Firm*—Allen D. Hertz

(57) ABSTRACT

A lace gripper having an upper body and a lower body that may be joined together whereby a tied lace is secured between the two bodies. Preferable the upper body is designed to receive inserts, keys, charms, lights, recording devices, alarm and locating audible signals and locating devices, to allow the user to customize the lace gripper to their personal preference. The lace gripper can additionally be utilized to maintain a memo and would be secured to an object of daily use, such as a key ring or purse. Artwork for an image for the insert can be created by using software with a preset outline of the insert. Such software can be provided in softcopy or accessible via the Internet.

17 Claims, 8 Drawing Sheets

300a

LACE SECURING APPARATUS

RELATED US PATENT APPLICATION

This patent application claims priority to Utility application Ser. No. 11/333,154, filed Jan. 17, 2006, which is incorporated by reference herein.

BACKGROUND OF THE INVENTION

1. Field of the Invention

The invention relates generally to an apparatus for securing laces of a shoe. The apparatus comprises a folded piece of material that can wrap around adjoined laces to ensure that said laces stay adjoined.

2. Description of the Prior Art

There currently exist several methods for securing adjoined, or tied, laces. Often these methods involve the use of fine motor skills to engage the laces. The problem of laces becoming untied is typical for all shoes containing laces. For most adults this is an annoyance that is easily overcome by the re-tying of the lace. Most adults have life experience that teaches them to retie their laces so that a dangerous accident can be avoided from the tripping over of untied laces. However, children often over look this danger because they lack life experience or the untied lace goes unnoticed. In addition, there are several occasions where adults will also notice that a lace is untied until it is pointed out to them or they trip on the lace. Therefore, there is a need to have an invention that is inexpensive, easy to use and desirable to use to prevent laces from coming untied.

The invention, in its simplest form, must be inexpensive because the use of the lace gripper will be primarily by children and they tend to destroy and lose attachable items. In addition the safety feature has to fit into a family budget.

The invention must be easy to use because the primary market to the lace gripper is going to be small children and adults who will not or cannot retie their laces.

The invention must be desirable to the user because children must want to use the lace gripper in order for it to be an effective safety measure.

The invention must keep laces secured because the safety feature is to eliminate the tripping over of laces.

The invention is also useful for adults that may not be able to tie their laces when they come undone. For example, athletes may not want to interrupt their athletic perform to tie their laces. In addition, adults may have disabilities that make it impossible or difficult to tie or retie their laces. Thus an invention to secure a tied lace is desirable for these individuals.

The invention should have optional features for users who desire more safety and are less concerned about price. These features should include signaling means to both sound and alarm and locate the user.

Past efforts have attempted to solve the problem of untied laces by providing complicated devices that integrate with laces to secure one end of the lace to another. In addition, these methods do not offer interchangeability in design that would make them universally appropriate for securing laces. An example of how these prior inventions are limited are that they require a more complicated securing process and they have only one outwardly appearance that may not be desirable or appropriate for the laces that are being secured.

None of the prior art couple the securing of laces with added security features such as sounds alarms or locating signals to find wayward users. None of the prior art provides a means for presenting interchangeable images onto shoes.

The prior art fails to teach a means for storing a key, or similar object, into a small pocket of an object that secures to one's shoelaces.

The prior art fails to teach the inclusion of an image within a transparent pocket of an object that secures to one's shoelaces. With that, it is further limited by not providing software to create such artwork using a preset image outline for such an insert, further wherein said software is available via the Internet.

Therefore, the present invention addresses the great need to develop an apparatus that is easy to use, inexpensive and desirable to use.

The present invention relates to a lace gripper that wraps around tied laces to secure the tied knot within.

The present invention further discloses an easy to use apparatus that wraps around tied laces to secure the tied knot within.

The present invention further discloses a desirable apparatus that wraps around tied laces to secure the tied knot within that may be changed in appearance to fit the activity being performed or appearance required by the user.

The present invention further discloses a desirable apparatus that wraps around tied laces to secure the tied knot within that may be configured with additional safety features from sounding alarms and locating wearers.

Nothing in the prior art references disclose an apparatus or method that utilizes a combination of these elements to facilitate the securing of tied laces.

SUMMARY OF THE INVENTION

According to the present invention, a lace gripper, or apparatus is disclosed.

An object of the present invention is to disclose an apparatus that is easy to use so that young children or disabled adults can use the present invention.

It is an object of this invention to provide an inexpensive apparatus that wraps around tied laces to secure the tied knot within, said apparatus referred to as a lace gripper.

A second objective is to disclose a desirable to use said apparatus that wraps around tied laces to secure the tied knot within, wherein said apparatus may be changed in appearance to fit the activity being performed or appearance required by the user.

A third objective is to disclose a desirable to use said apparatus that wraps around tied laces to secure the tied knot within, wherein said apparatus may have additional safety features for sounding alarms or locating signals for wayward wearers.

A fourth aspect of the present invention is the application of a fabric as a lace gripper, wherein said fabric comprising an outer surface and a joining surface. Said outer surface would be visible when used, said joining surface would be folded such to contact itself and therefore would not be visible when used.

A fifth aspect of the present invention is the inclusion of a fastener, wherein said fastener would be coupled to said joining surface of said fabric.

A sixth aspect of the present invention is the inclusion of a fastener, wherein said fastener would be coupled to said joining surface of said fabric, wherein said coupler is at least one of: Velcro® (a dense hook and loop fastening system); a snap; a button; a ribbon or string tie, a hook and eye; and a loop and knot.

A seventh aspect of the present invention is the incorporation of a fabric stiffener, wherein said fabric stiffener would be coupled to said joining side of said fabric.

An eighth aspect of the present invention is the incorporation of a member to at least one of to hold and insert flat images.

A ninth aspect of the present invention is the incorporation of a member to at least one of to hold and insert flat images, wherein said member is a clear, flexible material, spanning across an upper, outer surface.

A tenth aspect of the present invention is the incorporation of a member to at least one of to hold and insert an image, wherein said member is narrow frame for containing said image on at least three sides.

An eleventh aspect of the present invention is the incorporation of a charm holder, wherein said charm holder.

A twelfth aspect of the present invention is the incorporation of a charm holder, wherein said charm holder is a charm bar coupled to said top, upper surface of said lace gripper.

A thirteenth aspect of the present invention is the incorporation of a charm holder, wherein said charm holder is a charm bar coupled to said top, upper surface of said lace gripper.

A fourteenth aspect of the present invention is the incorporation of a charm holder, wherein said charm holder is a horizontal strip of fabric incorporated in said top, upper surface of said lace gripper.

A fifteenth aspect of the present invention is the incorporation of a charm holder, wherein said charm holder is a charm chain coupled to said top, upper surface of said lace gripper.

A sixteenth aspect of the present invention is the incorporation of a charm holder, wherein said charm holder is at least one of a tie and ribbon coupled to said top, upper surface of said lace gripper.

A seventeenth aspect of the present invention is the utilization of said invention as a means to hold a daily tasks list.

An eighteenth aspect of the present invention is the utilization of said invention as a means to hold a daily tasks list, wherein said lace gripper is secured to a person's purse.

A nineteenth aspect of the present invention is the utilization of said invention as a means to hold a daily tasks list; wherein said lace gripper is secured to a person's key ring.

A twentieth aspect of the present invention is the utilization of printed fabric as the primary material for said lace gripper. Several examples would be utilization of cartoon characters, sports logos, sports related images, and the like.

A twenty-first aspect of the present invention is the utilization of leather, suede, silk, satin, lace and other materials for said fabric as the primary material for said lace gripper.

A twentieth aspect of the present invention is the utilization of a metal coupling apparatus, wherein said metal coupling apparatus is shaped similar to a clothes hanger and used to couple said lace gripper to another object such as a key-ring.

A twenty-first aspect of the present invention is a lace gripper wherein said lace gripper is of a length to hold a key.

A twenty-second aspect of the present invention is a lace gripper wherein said lace gripper is of a length to hold a key, and further comprising a pocket for holding said key.

A twenty-third aspect of the present invention is a lace gripper wherein said lace gripper is of a length to hold a key, and further comprising a pocket for holding said key, wherein an opening for said key pocket is located on the inside of said lace gripper.

A twenty-fourth aspect of the present invention is a lace gripper wherein said lace gripper is of a length to hold a key, and further comprising a pocket for holding said key, wherein an opening for said key pocket is located on the outside of said lace gripper.

A twenty-fifth aspect of the present invention is software including the outline of said insert, wherein the software provides the process of designing said insert for said lace gripper.

A twenty-sixth aspect of the present invention is software including the outline of said insert, wherein the software provides the process of designing said insert for said lace gripper, wherein said software resides on a website.

A twenty-seventh aspect of the present invention is software including the outline of said insert, wherein the software provides the process of designing said insert for said lace gripper, wherein said software resides on a website, said website further comprising sale of charms, lights, and other accessories.

A twenty-eighth aspect of the present invention is software including the outline of said insert, wherein the software provides the process of designing said insert for said lace gripper, said software comprising all of the standard elements for drawing, editing, importing, text, and the like for design & decorating an image for said insert.

Still further objectives will become apparent from the disclosure herein and are claimed as objects of the invention as if described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Figure 1C:
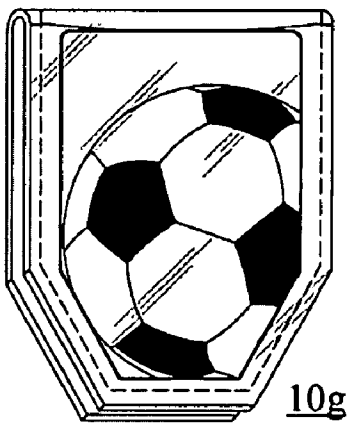
FIGS. 1*a* through 1*g* presents a detailed view of a lace gripper, further comprising an embodiment allowing for the insert of various images.

Shown throughout the figures, the present invention is directed towards a lace gripper. Like element references are used through the various figures.

FIGS. 1*a* through 1*g* illustrates a lace gripper 10 (shown as 10A-10*p* herein), said lace gripper comprising a lace gripper upper body 20 and a lace gripper lower body 30. Said lace gripper upper body 20 has an upper body outer surface 40 and an upper body joining surface 50. Said lace gripper upper body 20 is the portion of said lace gripper 10 that is visible when used. Said lace gripper lower body 30 has a lower body outer surface 60 and a lower body joining surface 70. Said lace gripper lower body 30 is the portion of said lace gripper 10 that is not visible when used, placed behind said lace gripper upper body 20. Said upper body joining surface 50 and said lower body joining surface 70 further comprise an interlocking means 80 used as a means for securing said upper body joining surface 50 and said lower body joining surface 70, forming a loop about an object such as laces. In one embodiment interlocking means 80 is Velcro®. However, any means for joining said upper body joining surface 50 and said lower body joining surface 70 is contemplated herein whereby tied laces may be clamped in between said upper body joining surface 50 and said lower body joining surface 70, including, but not limited to a snap; a button; a ribbon or string tie, a hook and eye; and a loop and knot.

Figure 1B:
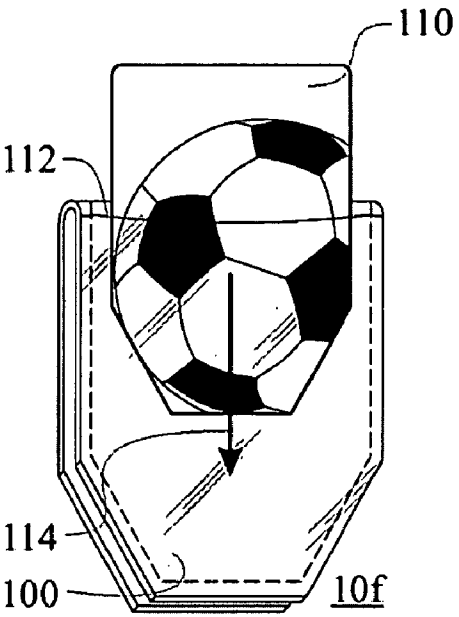
Figure 1A:
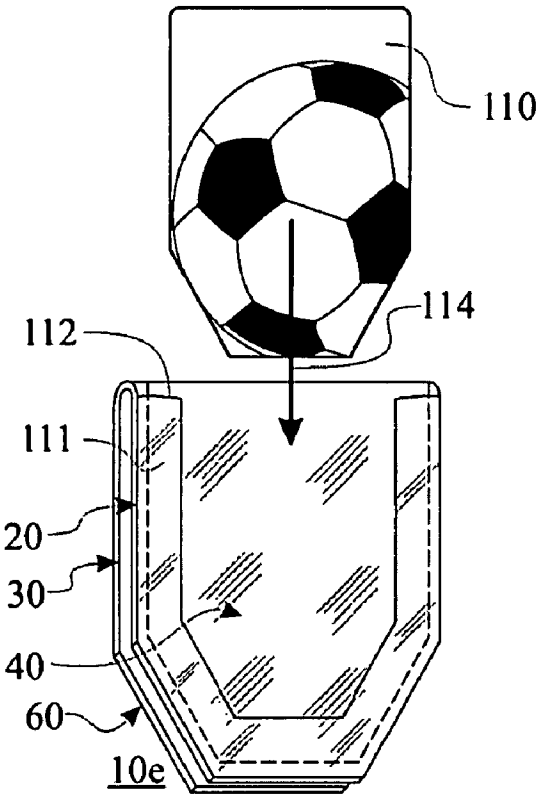
Figure 1G:
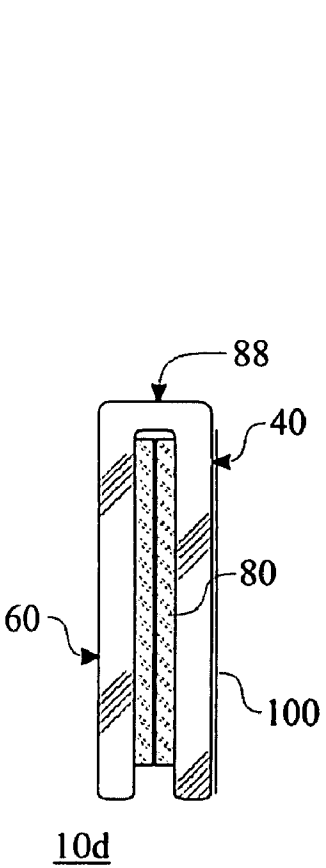
Figure 1F:
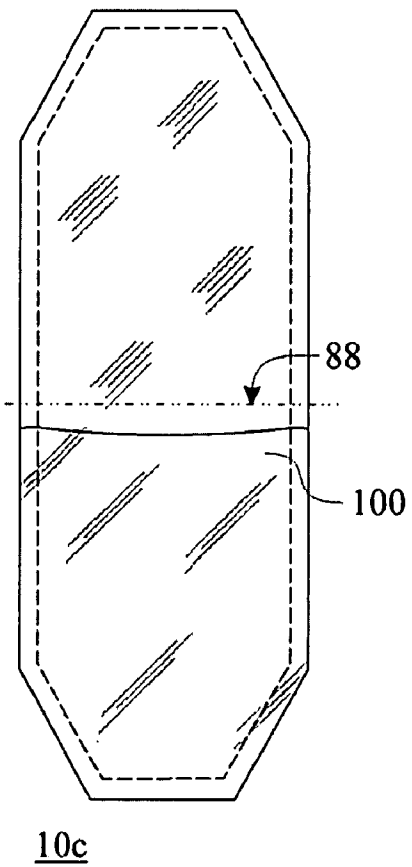
Figure 1E:
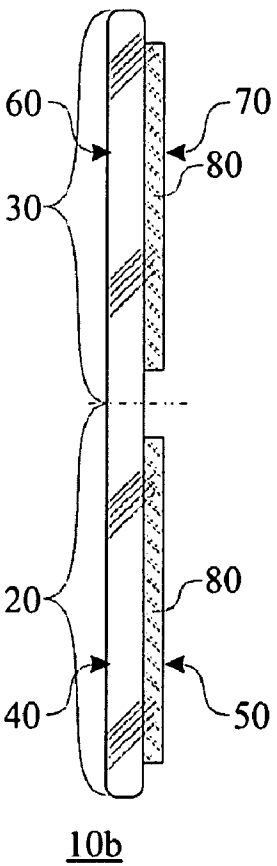
Figure 1D:
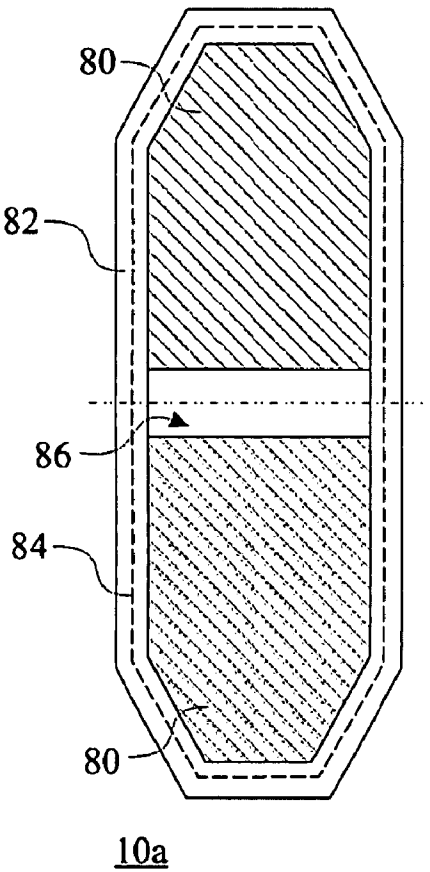
Figure 2C:
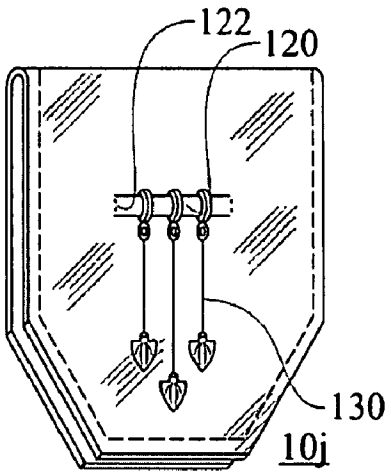
FIGS. 2*a* through 2*g* presents a detailed view of the lace gripper, further comprising an embodiment allowing for the attachment of charms.
Figure 2B:
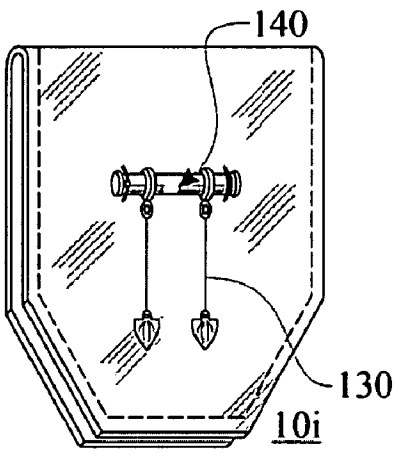
Figure 2A:
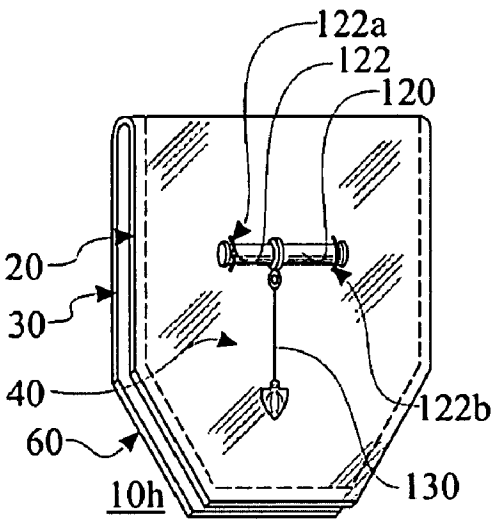
Figures 2D, 2E, 2F, 2G:
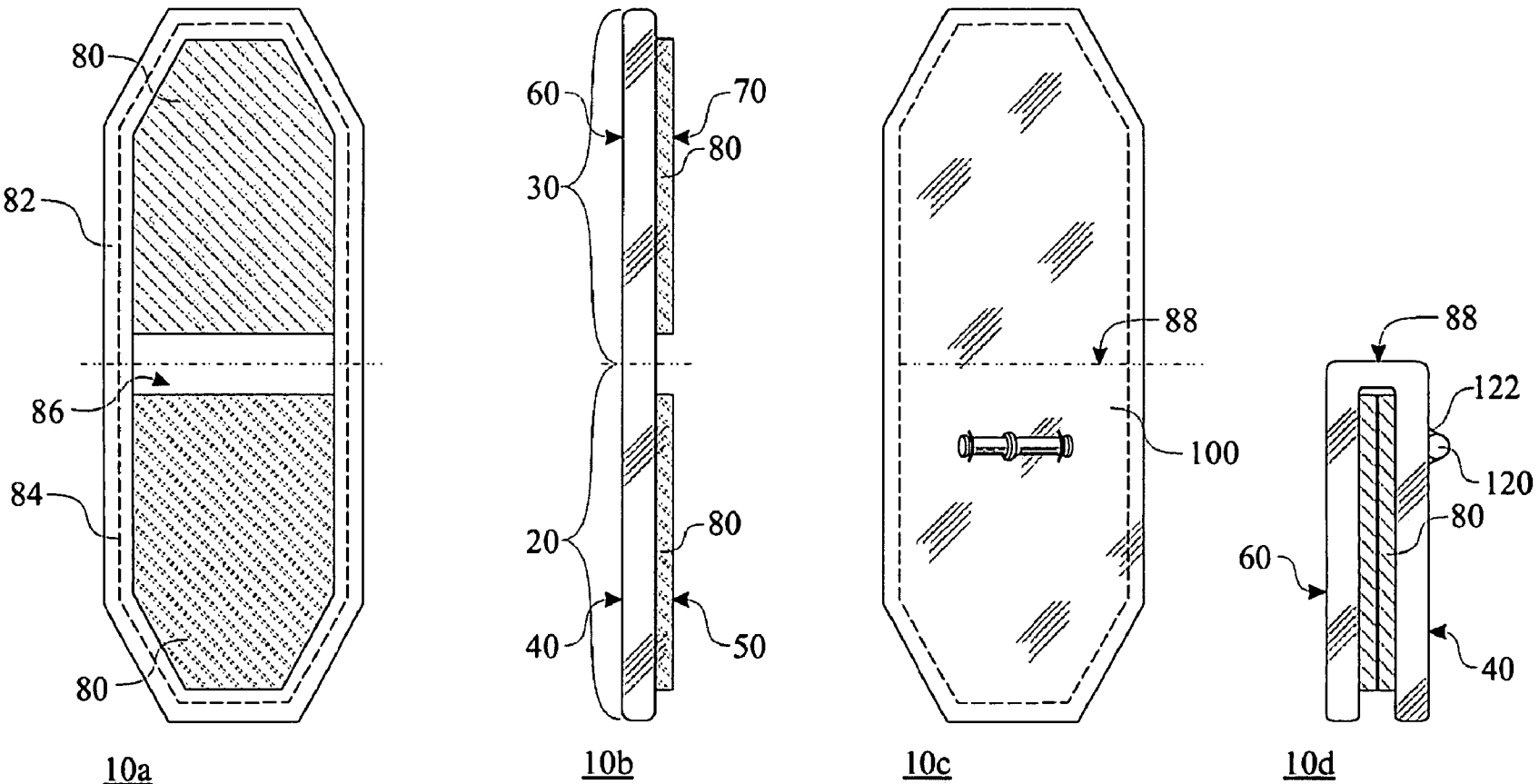

Optionally, said upper body outer surface 40 may have an attaching means (shown as several members herein) to attach various aesthetic items to make the use of said lace gripper 10 more appealing to the user. Said lace gripper 10 is presented in 4 orientations: an unfolded bottom/joining section view 10*a*, an unfolded side view 10*b*, an unfolded top/outer section view 10*c*, and a folded side view 10*d*. In one embodiment, said upper body outer surface may comprise a pocket/channel 100 completely covering (or an image slot 111 disposed around the perimeter of) said upper body outer surface 40. Said pocket/channel 100 (or said image slot 111 used interchangeably herein) will create an image pocket 112 for holding an insert 110. Said illustration presents the steps of inserting 114 said insert 110 into said image pocket 112, said process is detailed via: an orienting step 10*e* for orienting said insert 110 and aligning said insert with said pocket/channel 100; an insertion step 10*f* for inserting 114 said insert 110 into said pocket/channel 100; and seating step 10*g*, for seating said insert 100 to the base of said pocket/channel 100. Said insert 110 comprising printed card stock of various pictures to suit the personal preference of the user. For example, as shown in FIGS. 1*a* through 1*c*, a soccer ball may be imprinted on said insert 110, which would indicate the users fondness or participation in the activity. Alternatively, said insert 110 can comprise notes for reminding the user of various tasks, inspiration phrases, dates such as a calendar or other such messages. There is no limitation contemplated on the subject matter of printed material on said insert 110. In fact, said insert 110 may be left blank in which case the user may design their own graphic on said insert 110. Moreover, there is no limitation on the means of attaching said insert 110 to said upper body outer surface 40. For example, said insert 110 and said upper body outer surface 40 may also be coupled via Velcro® coupled on opposite joining sides, adhesive, and the like. The configuration of having said attaching means shown herein as a pocket/channel 100 allows the user to change said insert 110 easily to allow several aesthetic themes. Moreover said lace gripper 10 may be used without said insert 110 at all.

Said lace gripper 10 can be fabricated in accordance with the following process. A stiffening material 86 is coupled to said joining side of a sheet of fabric. An outline of said lace gripper 10 is transferred to said stiffened sheet of fabric. One such means to transfer said outline would be to cut the sheet of fabric to shape, including any seam allowance 82 as required. An optional attaching means is then positioned and coupled to said stiffened sheet of fabric. Any seam allowance 82 is folded under as shown in said unfolded bottom side view 10*a*. A seam 84 secures said seam allowance 82. Additionally, said seam 84 can be used to secure said attaching means. Alternatively, the cut edge of the material can be finished to avoid fraying by a process known as surging. Said interlocking means 80 are then coupled to said joining surfaces 50, 70. Said lace gripper is then folded along a fold 88 as illustrated in said folded side view 10*d*.

FIGS. 2*a* through 2*g* presents a lace gripper 10 in accordance with an alternate embodiment, wherein said upper body outer surface 40 of said lace gripper 10 incorporates a charm attaching means 120 to attach user-selected charms 130. Said charms attaching means 120 is preferable a charm bar 140 secured to said upper body outer surface 40 via a charm attaching means coupling apparatus 122—more specifically, the preferred embodiment is a secured coupling member 122*a* at a first end and a removable coupling member 122*b* attached to said upper body outer surface 40 at an opposing end of said charm attaching means 120. By having one end of said charm bar 140 removable secured on one end the user may selectively add or remove said selected charms 130. Said selected charms 130 can be used for aesthetic appeal or used to convey membership, affiliation or approval of groups and activities symbolic. For example a group of friends can create a group of said selected charms 130 that represent the group of friends. Also, those involved in specific activities can select said charms 130 the represent those activities. In addition, said selected charms 130 can be matched to other jewelry being worn by the user to complete an their outfit. In a modified version, said charm attaching means 120 can be a strip of fabric, string, ribbon, and the like as presented in FIG. 10*j*. Said modified charm attaching means could be fabricated by incorporating two horizontal slits into the fabric as shown. It can be recognized that any number of charm attaching scenarios can be incorporated into said lace gripper while maintaining the spirit and intent of the present invention.

Figure 3A:
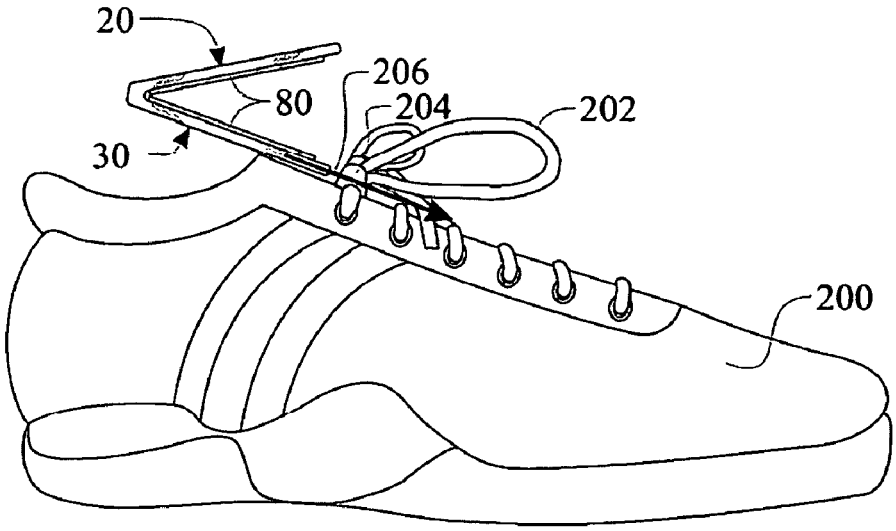
FIGS. 3*a* through 3*c* presents a diagram illustrating the steps of inserting said lace gripper onto footwear and securely fastening said lace gripper around a tied knot.
Figure 3B:
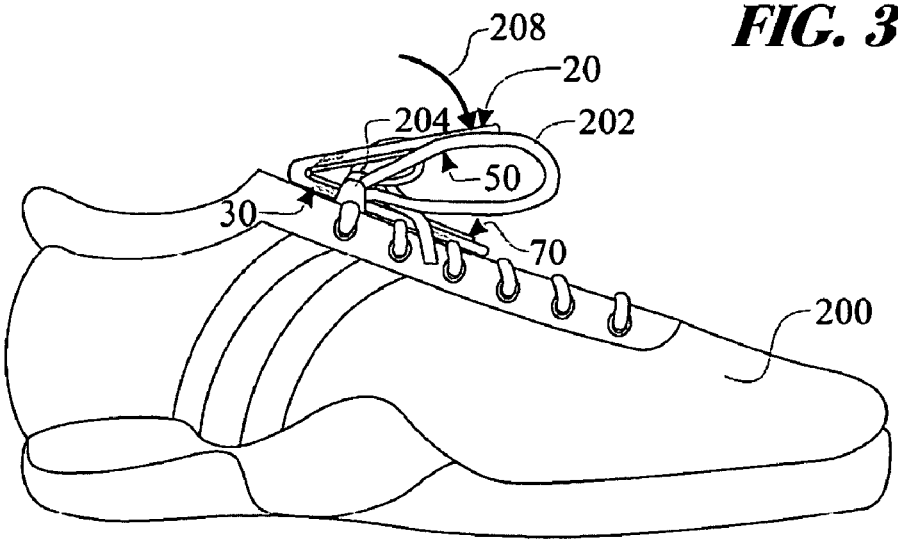
Figure 3C:
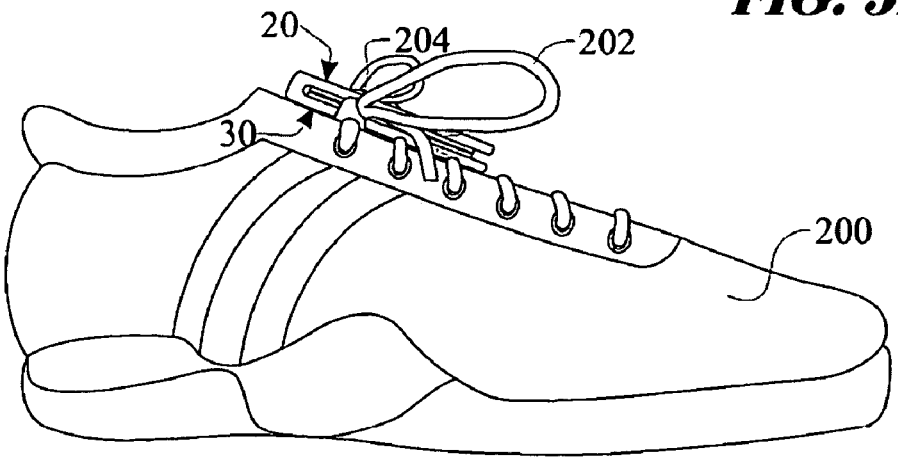
Figure 4A:
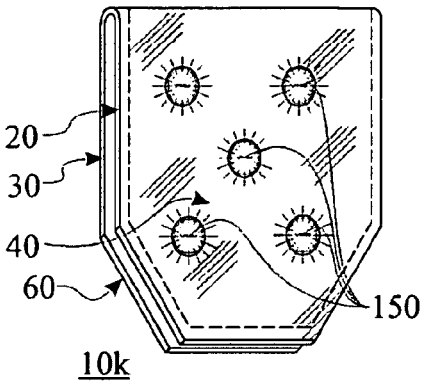
FIGS. 4*a* through 4*d* presents various views of said lace gripper, further comprising additional embodiments of the present invention.
Figure 4B:
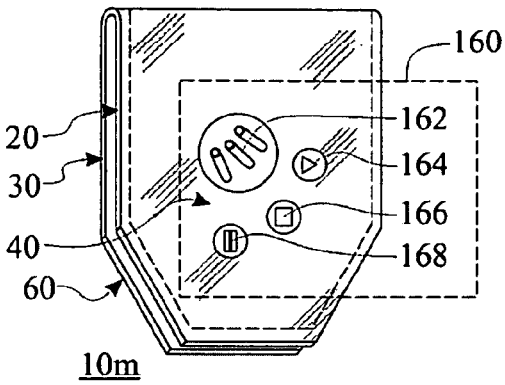
Figure 4C:
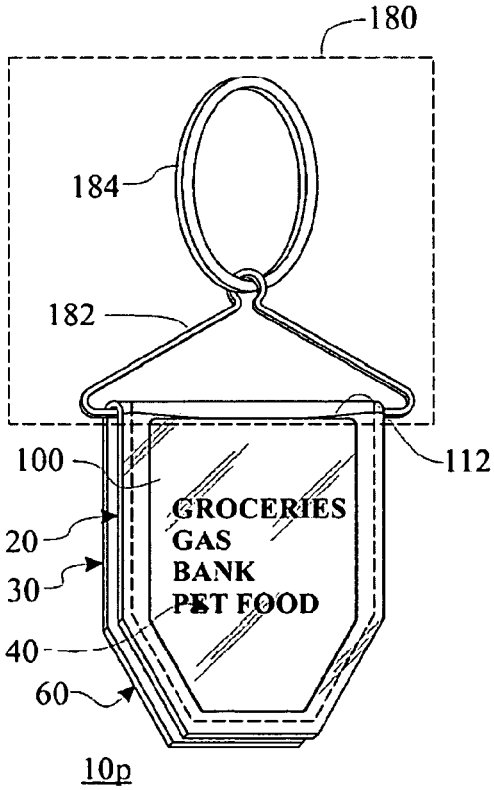
Figure 4D:
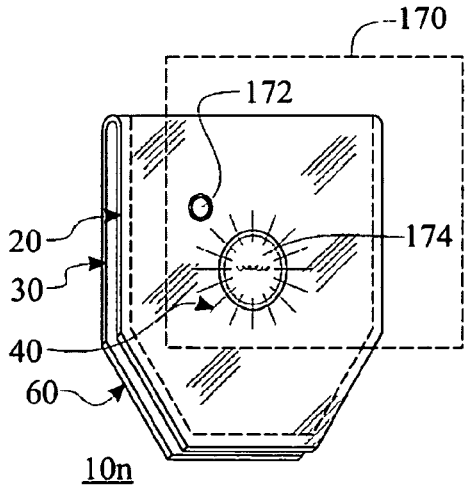
Figures 5A, 5B, 5C, 5D:
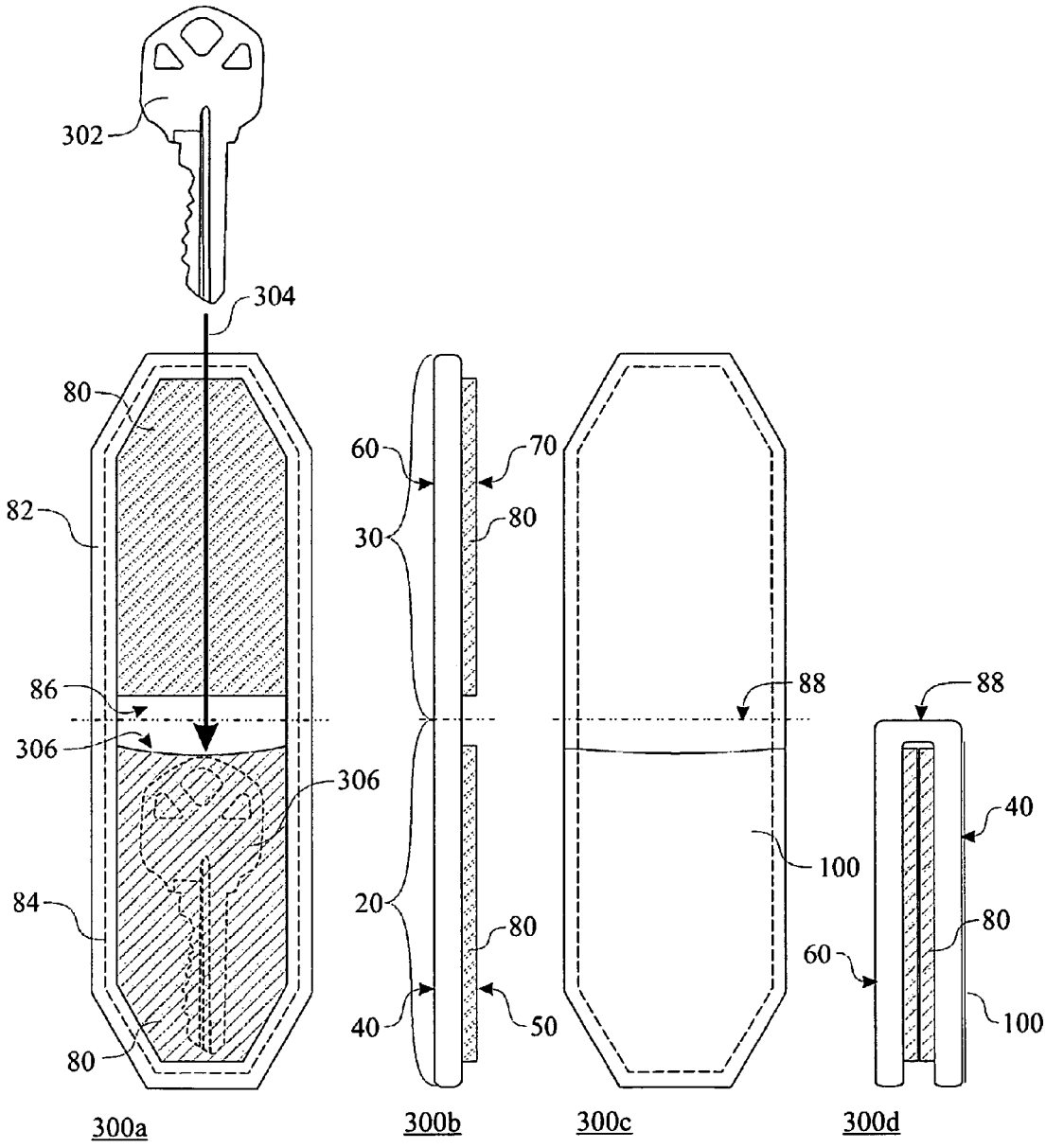
FIGS. 5*a* through 5*d* presents a detailed view of the lace gripper, further comprising an embodiment providing for storage of a key.

FIGS. 3*a* through 3*c* presents a representative flow for applying said lace gripper to footwear 200 in accordance with the preferred embodiment. The method of using said lace gripper 10 comprising: inserting said lace gripper lower body 30 between the tongue of said footwear 200 (not shown, but widely understood) and laces 202 used to secure said footwear 200, while leaving said lace gripper upper body 20 extending outwardly from said laces 202. The preferable insertion location would be about a lace knot 204 to ensure said laces 202 remain tied. The midpoint (fold 88 position) of said lace gripper 10 should be positions at the point where said laces 202 will be tied (lace knot 204). Then the user tightens said laces 202 and ties said laces 202 of said footwear 200 as they normally would. It can be recognized that the user may tie said laces 202 prior to inserting said lace gripper 10. After which, said lace gripper upper body 20 is folded over 208 (along fold 88) about the tied laces (lace knot 204) until said upper body joining surface 50 and said lower body joining surface 70 are joined securing via said interlocking means 80. Thus the tied laces (lace knot 204) are secured between the two bonded surfaces of said lace gripper 10. Said inserts 110 or said selected charms 130 may have been previously positioned on said upper body outer surface 40 or may be so positioned or changed at this time.

FIGS. 4*a* through 4*d* presents additional embodiments not shown in the previous figures. In one such embodiment, said upper body outer surface 40 may incorporate or contain a desired pattern of lights 150, as illustrated in a lighting embodiment 10*k*. Currently, there are many shoes for children that have lights built into the shoes. However, these lights often become non-functioning prior to the useful life of the shoe. However, if said attached desired pattern of lights 150 is used it may be reenergized by the replacement of a battery or replaced altogether. Typically said desired pattern of lights 150 will be activated upon detection of motion. Alternately, said lights can be activated via a switch. Said lights can be incandescent bulbs, LEDs, fiber optics, and the like. Said lights can additionally flash, flash in patterns, etc. to gain attention. Said lights or ends of fibers can be fashioned into images.

In accordance with another alternate embodiment, attached to said upper body outer surface 40 may be a message-recording device 160, as illustrated in a recording embodiment 10*m*. Said message recording device 160 comprising a memory apparatus (not shown), a power source (not shown), a recording transducer 162, recording play controller 164, a recording stop controller 166, and a recording recorder controller 168. Said message recording device 160 could contain a recorded message from a parent reminding the child user to do something or conveying a message of endearment. Also, said recording device 160 could be used to store critical information like a home address or cell phone number in the event that a child gets lost. Additionally, said recording device could transmit an alarm or locating signal. Typically, said recording device 160 would be activated by depressing a button or remotely by a parent or caretaker.

In accordance with another alternate embodiment, either said lace gripper 10 or any of the said upper body outer surface 40 attachments may be fitted with a location device that allows a parent or caretaker to locate the position of the wearer utilizing wireless locating technology, as illustrated in a signaling embodiment 10*n*. This is accomplished through embedding a signaling device 170 in either the lace gripper 10 or any of the said upper body outer surface 40 attachments, and providing a receiving means to said parent or caretaker. Said signaling device 170 can optionally comprise a signaling device controller 172 and a signaling device warning apparatus 174. The wearer would activate said signaling device 170 via the said signaling device controller 172. Once activated, said signaling device 170 would transmit a signal back to said parent or caretaker. Optionally, said signaling device 170 would also provide an audible or visual alert via said signaling device warning apparatus 174.

In accordance with another alternate embodiment, said lace gripper 10 may be fitted with a lace gripper coupling apparatus 180 that provides a means for said lace gripper 10 to be secured to other objects such as a key-ring or purse, as illustrated in a note keeping embodiment 10*p*. Said lace gripper coupling apparatus 180 can comprise a lace gripper hanger 182 and optionally a coupling loop 184. Said hanger comprising a long, strait section for securing said lace gripper 10 and a smaller loop section for coupling to a key ring, loop on a purse, and the like.

Finally, it should be noted that all of the attachable features contained herein can be used in conjunction with each other or separately.

The primary goal of allowing user selection of various methods to display said inserts 110 and said selected charms 130 is to achieve the goal of getting the user to use said lace gripper 10.

The primary purpose of lace gripper 10 is to provide a means for securing shoe laces to avoid annoyance and provide safety to those would otherwise ignore untied laces and possibly trip over their untied laces.

An alternate purpose of lace gripper 10 is to provide a means for maintaining a task list or other such notes.

FIGS. 5*a* through 5*d* presents an additional embodiment of the present invention, wherein said lace gripper 10 is illustrated as a key holding lace gripper 300, further presented in 4 orientations: an unfolded bottom/joining section view 300*a*, an unfolded side view 300*b*, an unfolded top/outer section view 300*c*, and a folded side view 300*d*. Said unfolded bottom/joining section view 300*a* presents a lace gripper key pocket 306 on the inside of said key holding lace gripper 300. A user would insert a key 302 in accordance with a key insertion 304. It is understood that said key pocket 306 could alternately be positioned on the exterior of said key holding lace gripper 300. Said key 304 is shown in phantom as an inserted key 308, placed in a stored position.

Figure 6:
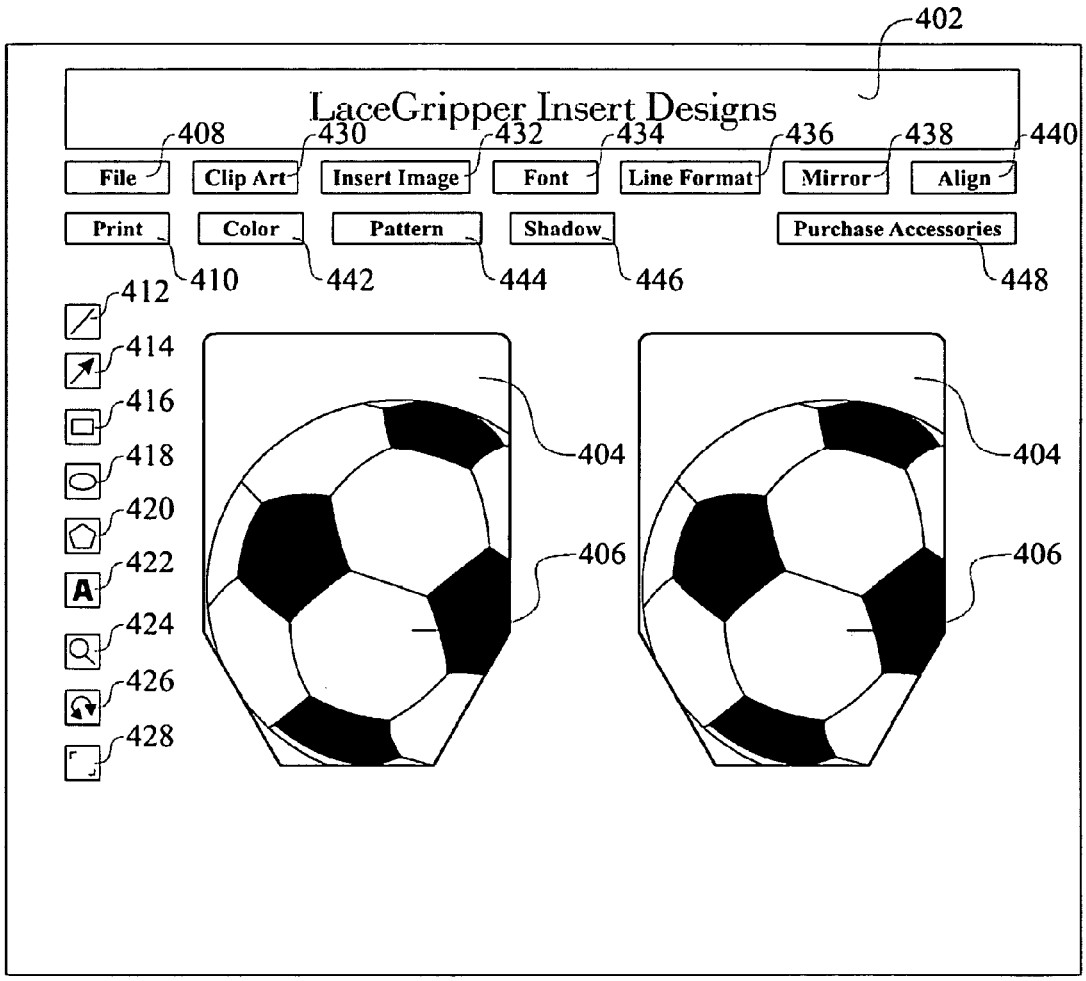
FIG. 6 presents a web page, wherein said web page is representative of software for designing an insert for said lace gripper.

FIG. 6 presents an insertion design screen view 400. Said insertion design screen view 400 presents various features representative of software for creating a user-designed image 406 onto an owner designed insert 404. Said insertion design screen view 400 would comprise at least one of the following elements:

a. software header 402;
b. file menu 408 for opening, saving, and like functions;
c. print menu 410 for printing, print preview, page setup and like functions;
d. line drawing function 412 for drawing strait, curved, and multi-point lines;
e. select function 414 for selecting one or more elements of said user designed image 406;
f. rectangle drawing function 416 for drawing square and rectangular shaped elements;
g. oval drawing function 418 for drawing circular and elliptical shaped elements;
h. polygon drawing function 420 for drawing any shaped polygons, said function may include an option for establishing a number of sides for said polygon shaped elements, as well as inverting said polygon to create stars;
i. text insertion function 422 for inserting text into said user designed image 406;
j. viewing scaling function 424 for zooming in or out of the viewing area;
k. rotating function 426 for rotating a selected element or group of elements;
l. cropping function 428 for cropping a selected element, group of elements, image, and the like;
m. clip art menu 430 for inserting, manipulating, and like functions respective to clip art to be applied to said user designed image 406;
n. insert image menu 432 for inserting, manipulating, and like functions respective to an image provided by a source other than clip art to be applied to said user designed image 406;
o. font format menu 434 for modifying the font of selected text within said user designed image 406;
p. line format menu 436 for modifying the format of selected line(s), including thickness, type, style, curve features, and like functions;
q. mirror function 438 for inverting or mirroring one or more selected elements, said inverting can be horizontally, vertically, along a diagonal, along a user generated line, and the like;
r. alignment function 440 used for aligning an element or group of elements to another element, a page feature, or any other selectable item;
s. color function 442 for inserting, changing, and like functions of colors upon an element;
t. pattern function 444 for inserting, changing, and like functions of patterns upon an element, said patterns can be black and white, two-color, multi-color, textured, photo-like, and any other known pattern insertion feature;
u. shadow function 446 for creating, changing, directing, shading, and like functions of a shadow projecting from an element or plurality of elements; and
v. purchase accessories 448 which forwards the user to a location for purchasing of accessories for said lace gripper 10.

The software can be provided on a CD, accessible via the Internet, or available via any other manner. The user would operate the software to create said user designed image 406 within an outline of said owner designed insert 404. The software can optionally crop said user designed image 406 to the outline of said owner designed insert 404 by using said cropping function 428. It should be noted that additional features could be included to the above software.

It should be noted, that the specific apparatus and method described of utilizing the present invention is only one example and is provided for illustrative purposes only. A wide variety of other applications and uses adaptable and configured for specific conditions are contemplated.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A lace gripper, said lace gripper comprising:

a contiguous material having an outer surface and a joining surface, said contiguous material having an upper body and a lower body defined by a fold located therebetween, the upper body and the lower body each including the outer surface and the joining surface;

a fastening material substantially covering the joining surface of the contiguous material, excluding an area proximate said fold;

at least one key pocket, wherein said key pocket is of a shape and size to contain at least one of a standard sized house key and a standard sized automobile key, wherein a key insertion opening of the at least one key pocket is proximate said fold;

footwear comprising a lace, the lace being tied in a lace knot;

the fold of the contiguous material covering only the portion of the lace respective to said lace knot; and the joining surfaces of each of the upper body and lower body are removably fastened to each other via said fastening material.

2. A lace gripper as set forth in claim 1, wherein said key pocket is accessible via said joining surface of said lace gripper.

3. A lace gripper as set forth in claim 1, wherein said key pocket is accessible via said outer surface of said lace gripper.

4. A lace gripper as set forth in claim 1, said lace gripper further comprising at least one of:

a) a charm holding apparatus;

b) an image pocket;

c) at least one light;

d) at least one light, wherein said at least one light becomes activated upon movement;

e) an audio recording device;

f) a signaling device comprising a transmitter; and g) a signaling device comprising an audio alarm.

5. A lace gripper as set forth in claim 1, said lace gripper further comprising an insert pocket, said insert pocket located on said outer surface of said upper body of said lace gripper.

6. A lace gripper as set forth in claim 1, wherein said contiguous material is of a fabric.

7. The lace gripper of claim 6, wherein an edge of said contiguous material is finished to avoid fraying.

8. The lace gripper of claim 6, wherein said fabric is stiffened by a stiffening material.

9. A lace gripper as set forth in claim 1, wherein said contiguous material is at least one of:

a) a printed material;

b) leather;

c) suede;

d) satin;

e) silk; and f) lace.

10. A lace gripper, said lace gripper comprising:

a contiguous material having an outer surface and a joining surface, said contiguous material having an upper body and a lower body defined by a fold located therebetween, the upper body and the lower body each including the outer surface and the joining surface;

a fastening material substantially covering said joining surface of said contiguous material, excluding an area proximate said fold for covering a tied portion of a shoe lace;

wherein said lace gripper is removable from said shoe; and an image pocket disposed upon said outer surface of said upper body and an insert placed within said image pocket via a pocket insertion opening located proximate said fold, wherein said image is viewable through said image pocket;

footwear comprising a lace, the lace being tied in a lace knot;

the fold of the contiguous material covering only the portion of the lace respective to said lace knot; and the joining surfaces of each of the upper body and lower body are removably fastened to each other via said fastening material.

11. A lace gripper as set forth in claim 10, wherein said contiguous material is of a fabric.

12. A lace gripper as set forth in claim 11, wherein said fabric is stiffened by a stiffening material.

13. A lace gripper as set forth in claim 10, wherein an edge of said contiguous material is finished to avoid fraying.

14. A lace gripper, said lace gripper comprising:

a contiguous material having an outer surface and a joining surface, said contiguous material having an upper body and a lower body defined by a fold located therebetween, the upper body and the lower body each including the outer surface and the joining surface;

a dense hook and loop fastening system substantially covering the joining surface of the contiguous material, excluding an area proximate said fold;

wherein said contiguous material is stiffened by a stiffening material;

wherein said lace gripper is removable from said shoe; and an image pocket disposed upon said outer surface of said upper body and an insert placed within said image pocket via a pocket insertion opening located proximate said fold, wherein said image is viewable through said image pocket;

footwear comprising a lace, the lace being tied in a lace knot;

the fold of the contiguous material covering only the portion of the lace respective to said lace knot; and the joining surfaces of each of the upper body and lower body are removably fastened to each other via said fastening material.

15. A lace gripper as set forth in claim 14, the lace gripper further comprising at least one key pocket, wherein said key pocket is of a shape and size to contain at least one of a standard sized house key and a standard sized automobile key.

16. A lace gripper as set forth in claim 15, wherein said key pocket is positioned on an interior of said lace gripper.

17. A lace gripper as set forth in claim 14, wherein an opening for insertion and removal of the insert is located proximate said foldable section.

* * * * *